US005163857A

United States Patent [19]

Hinsley

[11] Patent Number: 5,163,857

[45] Date of Patent: Nov. 17, 1992

[54] SELF-PROPELLED BOAT

[76] Inventor: George A. Hinsley, 6356 Gateway La., Knoxville, Tenn. 37920

[21] Appl. No.: 757,826

[22] Filed: Sep. 11, 1991

[51] Int. Cl.[5] ..... B63H 1/36

[52] U.S. Cl. ..... 440/14; 440/25; 440/21

[58] Field of Search ..... 440/14, 15, 21, 24, 440/25

[56] References Cited

U.S. PATENT DOCUMENTS

| | | | |
|---|---|---|---|
| 387,743 | 8/1888 | Smith | 440/24 |
| 2,555,886 | 6/1951 | Jones | 440/15 |
| 2,668,513 | 2/1954 | Reynolds | 440/24 |
| 2,803,837 | 8/1957 | Virobik | 114/351 |
| 2,809,604 | 10/1957 | Meredith | 440/14 |
| 3,855,957 | 12/1974 | Gross | 440/14 |
| 3,880,107 | 4/1975 | Miles | 440/21 |
| 4,943,251 | 7/1990 | Lerach et al. | 440/28 |
| 4,960,396 | 10/1990 | Stolzer | 114/351 |
| 5,000,706 | 3/1991 | Wang | 440/14 |

*Primary Examiner*—Edwin L. Swinehart
*Attorney, Agent, or Firm*—Pitts and Brittian

[57] ABSTRACT

A self-propelled boat (10) to be used by a boater to maneuver himself along the surface of a body of water, especially in shallow water where the use of a motorized boat or a deep bottom boat is impossible or otherwise impractical. The self-propelled boat (10) includes a body (12) to carry the boater and provide buoyancy. A seat (14) is provided on which the boater may be seated, the seat (14) being provided with a position adjuster (88) for fixing the seat (14) at selected positions along the longitudinal axis of the boat (10). A propulsion system (16) is provided such that the boat (10) may be maneuvered along the surface of the water. The propulsion system (16) includes a pair of foot mounts (146, 148) for engaging the feet of the boater to oscillate selected cords (132L, 132R, 138), the cords (132L. 132R, 138) being connected such as to form a loop. Bow and stern pulleys (98, 106) are provided for holding the cord (132) in place. As the cord (132) is oscillated, at least the stern pulley (106) is simultaneously oscillated. The stern pulley (106) then serves to oscillate a shaft (108) to which a flexible fin (154) is attached. Thus, as the fin (154) is oscillated, the boat (10) is propelled in reaction in a similar manner as a fish is propelled.

13 Claims, 4 Drawing Sheets

SELF-PROPELLED BOAT

TECHNICAL FIELD

This invention relates to the field of boating. More specifically, it relates to a self-propelled boat for maneuvering about a small body of water where larger boats are impractical or otherwise undesirable.

BACKGROUND ART

In the field of boating it is well known that a number of smaller lakes and streams are not suitable for typical fishing boats due mainly to shallow water. Narrow passageways in which maneuvering is required may also prohibit the use of conventionally powered boats. However, the quantity and quality of fish located in these difficult-to-reach areas make the areas desirable for fishing.

Other devices have been produced to propel a boat about the surface of a body of water. Typical of the art are those devices disclosed in U.S. Pat. Nos. 2,555,886 issued to W. L. Jones on Jun. 5, 1951; 2,809,604 issued to P. Meredith on Oct. 15, 1957; 3,855,957 issued to W. J. Gross on Dec. 24, 1974; 3,880,107 issued to J. C. Miles on Apr. 29, 1975; and 4,960,396 issued to L. Stolzer on Oct. 2, 1990. However, these patents do not disclose a boat with means for propulsion through a shallow body of water using an apparatus which is easy to operate and maintain. Other devices have been invented such as those disclosed in U.S. Pat. Nos. 2,803,837 issued to J. Virobik on Aug. 27, 1957 and 4,943,251 issued to T. E. Lerach, et al., on Jul. 24, 1990. These devices, however, are not suitable for shallow water maneuvering.

Therefore, it is an object of this invention to provide a means for maneuvering a boat in shallow water.

Another object of the present invention is to provide a boat with propulsion means which are easy to operate and maintain.

Still another object of the present invention is to provide a boat with propulsion means which may be operated by a boater's feet, while the boater's arms are free to accomplish other tasks such as fishing.

Yet another object of the present invention is to provide such a boat where the boater's feet are supported by the boat for the comfort of the boater.

It is also an object of the present invention to provide such a boat with a propulsion means which propels the boat in a substantially straight course and which may also be selectively turned in either direction.

DISCLOSURE OF THE INVENTION

Other objects and advantages will be accomplished by the present invention which is a boat which is designed to propel a boater along the surface of a shallow body of water using power derived through the boater's legs. The self-propelled boat of the present invention includes a body for carrying the boater and providing buoyancy. A seat is provided as a means for supporting the boater. A seat adjustment means is provided such that the seat may be moved along the longitudinal axis of the body such that boaters with longer legs may use the boat with the same ease that a boater with shorter legs. The seat adjustment means also serves to adjust the center of mass of the boater in order to maintain proper balance.

A propulsion means is provided such that the boat may be maneuvered along the surface of the water. The propulsion means includes a pair of foot mounts for supporting the feet of the boater. The foot mounts are each connected to one end of respective selected cords, the opposite ends of each cord being connected to a pulley attached proximate the stern. The foot mounts are further connected to opposite ends of a tensioning cord such that the foot mounts, selected cords and tensioning cord substantially form a loop. The foot mounts are attached on opposing sides of the loop such that as one is displaced in a first direction, the other is displaced an equal magnitude in the opposite direction.

The selected cords are held in place by two pulleys, one pulley being pivotally mounted at the bow and another pulley pivotally mounted at the stern. The tensioning cord is held in place by the bow pulley, and the two selected cords are attached to the stern pulley as described above. As the boater pushes the first foot mount forward and then the second foot mount forward, the cords serve to simultaneously oscillate at least the stern pulley. The stern pulley then serves to oscillate a shaft connected at one end to the center of the stern pulley.

A fin is connected to the stern pulley shaft such that as the shaft is oscillated, the fin is likewise oscillated and the boat is thus propelled in reaction to the movement of the fin. The stern pulley shaft is connected at either end to the stern such that movement is restrained to rotation about its longitudinal axis. The fin is fabricated from a flexible material such that as the fin is oscillated in the water, a movement similar to the fin of a fish is accomplished.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A self-propelled boat incorporating various features of the present invention is illustrated generally at 10 in the figures. The self-propelled boat 10 is designed to propel a boater along the surface of a shallow body of water using power derived through the boater's legs. Moreover, in the preferred embodiment the self-propelled boat 10 is designed to support the boater's feet as the boat 10 is propelled. The self-propelled boat 10 is also designed to be propelled in a substantially straight course while also being able to be selectively steered in either direction.

Figure 1:
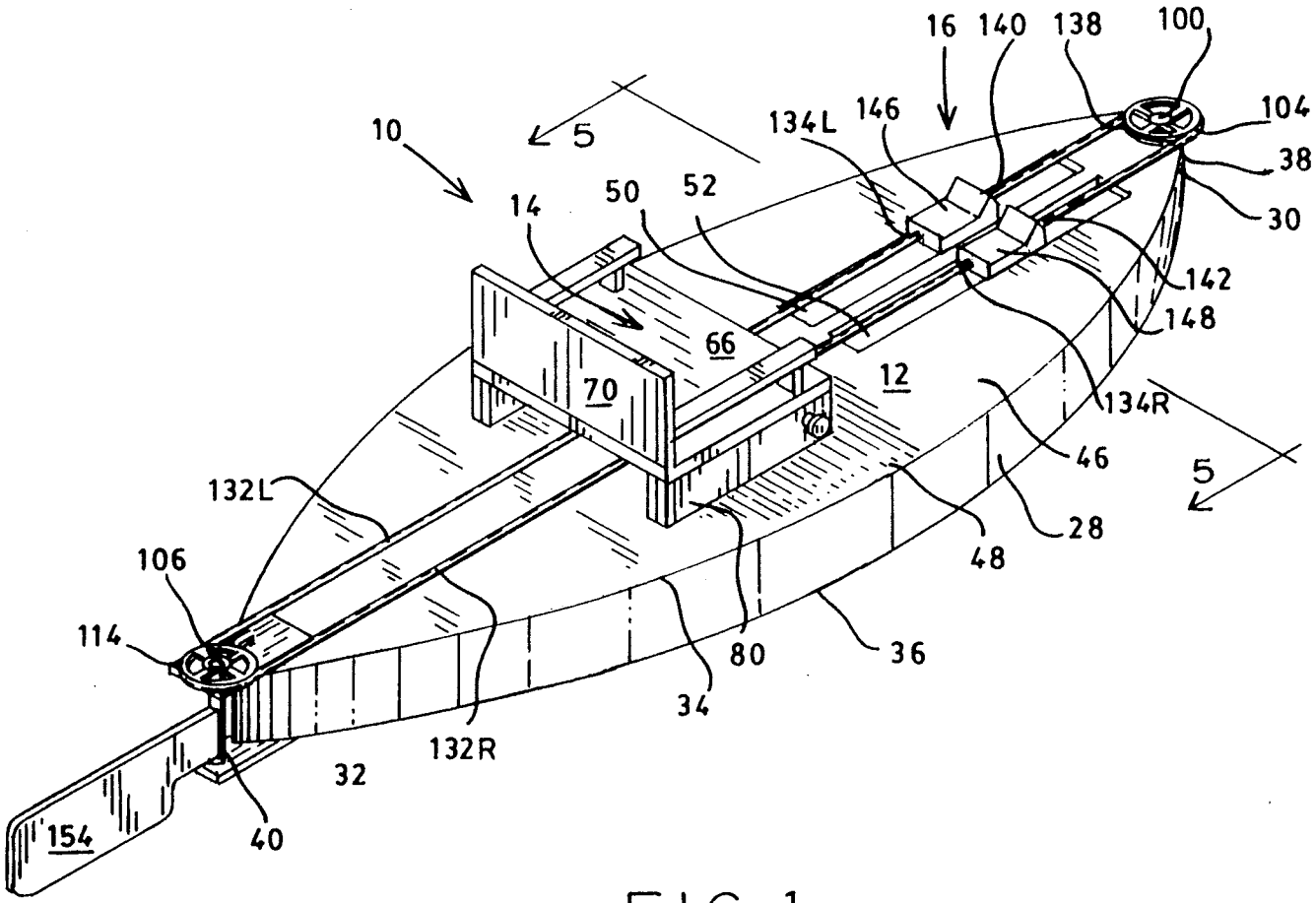
FIG. 1 is a perspective view of the self-propelled boat constructed in accordance with several features of the present invention.

Referring to FIG. 1 which is a perspective drawing of the self-propelled boat 10, a body 12 is provided for carrying a boater and selected gear such as fishing tackle (not shown). The body 12 is constructed with port and starboard side walls 18, 28, each being mirror images of the other. The side walls 18, 28 of the preferred embodiment are substantially vertical and have a substantially arcuate configuration. The side walls 18, 28 have respective first ends 20, 30 which are joined to define the bow 38 of the boat 10. The bow 38 of the preferred embodiment depends linearly toward the center of the boat 10 from the top body member 46 to the bottom body member 58. A substantially horizontal cross-section of the bow 38 defines an arc with ends tangent to the side walls 18, 28 (see FIG. 3). The side walls 18, 28 further have respective second ends 22, 32 which are joined to define the stern 40 of the boat 10. The side walls 18, 28 being so connected define a conventional cross-section of a marine vessel, with the broadest portion of the boat 10 being substantially midway between the bow 38 and stern 40, and with the side walls 18, 28 arcuately Converging at either end to define the bow 38 and stern 40 as described above. Further, the cross-section of the body 12 is substantially similar when taken about any horizontal plane along the height of the side walls 18, 28, excepting a shortening of the bow 38 toward the bottom member 58 of the boat 10.

The side walls 18, 28 further define top edges 24, 34 and bottom edges 26, 36. The respective top edges 24, 34 cooperate to define an opening 42. The respective bottom edges 26, 36 cooperate to define an opening 44. A top member 46 is configured to be closely received by the side walls 18, 28 within the top opening 42. In the preferred embodiment, the top member 46 and side walls 18, 28 are sealably attached proximate the top member outer edge 48 and the side wall top edges 24, 34. In another embodiment, the top member 46 is sealably attached to the side walls 18, 28 a selected distance below the side Wall top edges 24, 34 such as to form a lip 62 (see FIG. 5).

A bottom member 58 is sealably attached to the side walls 18, 28 proximate the bottom edges 26, 36. The bottom member 58 is configured to be closely received by the bottom opening 44 defined by the side wall bottom edges 26, 36. The bottom member 58 is sealably attached as described and the top member 46 is likewise sealably attached as described, thus a boat 10 is defined with a sealed inner volume 60 (see FIG. 5) which serves as a buoyancy means. In the preferred embodiment, the bottom member 58 has a substantially planar configuration, thereby allowing the self-propelled boat 10 to be deployed in a body of water with a depth approximately equal to or greater than the height of the side walls 18, 28.

A boater support 14 is carried by the body 12 for supporting the user of the boat 10. In the preferred embodiment, the boater support 14 is a conventional seat including at least a substantially horizontal planar member 66 and a seat attaching means 76 (see FIGS. 4 and 5) for attaching the boater support 14 to the body 12. A back 70 may be provided such that the user's back may be supported While the user is seated on the boater support 14. In the preferred embodiment, the back 70 is configured such that a bottom edge 72 is connected to the rearward edge 68 of the substantially horizontal planar member 66 and a top edge 74 is a selected height above the bottom edge 72. The back 70 may be attached to the boater support 14 by any conventional method such as with bolts, screws, or other fasteners. First and second arm rests 84, 86 may also be provided for selectively supporting the arms of a boater. The arm rests 84, 86 have a conventional configuration and may be selectively attached to either the substantially horizontal planar member 66 or the back 70, or both, in any conventional method as with bolts, screws, or other fasteners.

An adjusting means 88 is carried by the body 12 of the boat 10 for selectively altering the position of the boater support 14 along the top of the body 12. The adjustment means 88 is provided specifically for the adaptation of the boat 10 to persons with longer legs as well as those with shorter legs. The adjusting means 88 also serves to adjust the center of mass of the boater in order to maintain proper balance. The adjusting means 88 will be further described below in the detailed descriptions of FIGS. 4 and 5.

A propulsion means 98 is carried by the body 12 of the boat 10 for powering the boat 10 such that it may be maneuvered about the surface of a body of water. The propulsion means 98 includes at least one pulley-type wheel 98 affixed proximate the bow 38 (the bow pulley 98) and at least one pulley-type wheel 106 affixed proximate the stern 40 (the stern pulley 106), the bow pulley 98 and stern pulley 106 each defining an engagement portion 104, 114, respectively, for cooperating with a drive means 130 for oscillating at least the stern pulley 106. The center of the bow pulley 98 is fixed to one end 102 of a shaft 100. The shaft 100 is pivotally mounted to the body 12 of the boat, preferably on the top member 46 proximate the bow 38 and along the longitudinal axis of the boat 10. The shaft 100 is oriented in a substantially vertical position such that the bow pulley 98 will oscillate in a substantially horizontal plane a selected distance above the top member 46 of the boat 10.

The stern pulley 106 is attached to the stern 40 in similar fashion as the bow pulley 98, preferably along the longitudinal axis of the boat 10. The top end 110 of a vertically oriented shaft 108 is fixed to the center of the stern pulley 106, the shaft 108 being pivotally attached to the stern 40 of the boat 10 such that the stern pulley 106 is constrained to pivotal movement in a substantially horizontal plane. In the preferred embodiment, first and second plates 116, 122 are provided to extend from the stern 40 in order to displace the shaft 108 a selected distance from the body 12 of the boat 10. The first and second plates 116, 122 are substantially similar in configuration and are disposed oppositely, the first plate 116 being affixed to the top member 46 of the body 12 and the second plate 122 being affixed to the bottom member 58 of the body 12. The first and second plates 116, 122 are so affixed in a conventional manner such as with bolts or screws as shown at 128. The first and second plates 116, 122 define openings 118, 124 dimensioned to receive and secure the top and bottom ends 110, 112 of the shaft 108, respectively, such that the shaft 108 is constrained to rotation about its longitudinal axis. The stern pulley 106 is fixed to the shaft 108 a selected distance above the first plate 116, preferably at an elevation to place the bow pulley 98 and the stern pulley 106 in the same horizontal plane.

A drive mechanism 130 is provided to oscillate at least the stern pulley 106. The drive mechanism 130 includes an engagement portion 104, 114 of the stern and bow pulleys 98, 106 for attaching selected cords for oscillating at least the stern pulley 106 as described below. In the preferred embodiment, the selected cords include stern pulley engagement cords 132L, 132R, and a tensioning cord 138. In this embodiment, the first ends 134L, 134R of the engagement cords 132L, 134R, respectively, are releasably connected to foot mounts 146, 148. The first ends 134L, 134R, being releasably connected by any conventional means, may be adjusted to lengthen or shorten the engagement cords 132L, 132R in order to compensate for longer- or shorter-legged boaters. The second ends 136L, 136R are each connected to the stern pulley 106.

Figure 8:
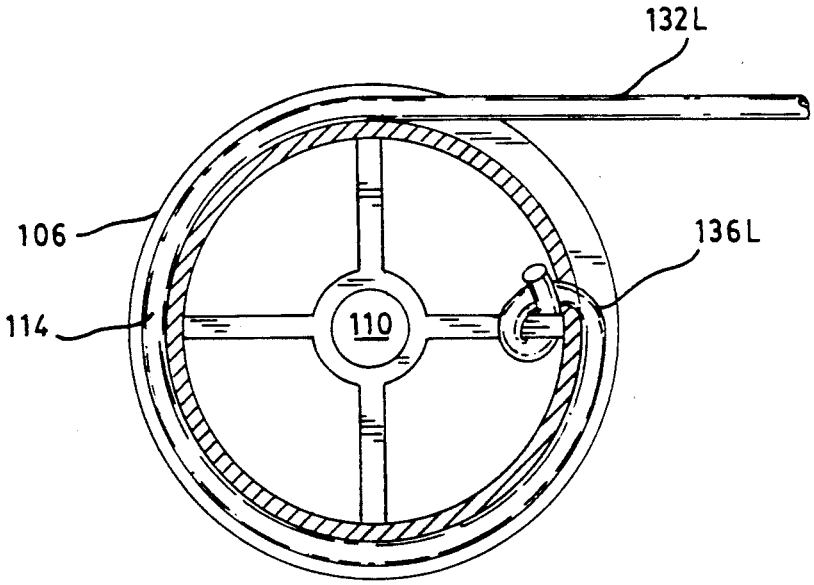
FIG. 8 is a partial top plan view illustrating the connection of the left selected cord to the stern pulley.

Preferably, the second ends 136L, 136R of the engagement cords 132L, 132R are wrapped around the stern pulley 106 at least three-quarters of a turn (270°) and fixed to the stern pulley 106 such that as the left cord 132L is tensioned to the full extent, the stern pulley 106 will be rotated clockwise, and as the right cord 132R is tensioned, the stern pulley 106 will be rotated counter-clockwise. (See FIG. 8). The angle of rotation of the stern pulley 106 is dependent on the radius of the stern pulley engagement portion 114 and the magnitude of displacement of the foot mounts 146, 148. It will be seen that a larger diameter engagement portion 114 will inhibit a smaller degree of rotation and a smaller diameter engagement portion will inhibit a larger degree of rotation.

The first and second ends 140, 142 of the tensioning cord 138 are connected to the foot mounts 146, 148, respectively, such that as the foot mounts 146, 148 are biased toward one another in the direction of the bow 38 of the boat 10. Thus, the engagement cords 132L, 132R are kept in a taut fashion. The tensioning cord 138 may be fabricated from an elastomeric material such as a rubber cord. Although not shown in the figures, it is also envisioned that the tensioning cord 138 may be comprised of a cord having non-elastic properties and at least one biasing device such as a spring connected in an end-to-end fashion to the nonconnected elastic cord and at least one foot mount. The described configuration can be seen to define a substantial loop configuration maintaining a constant circumference dimensioned to be closely received by the bow pulley and the stern pulley engagement portions 104, 114.

In the preferred embodiment, the selected cord 132 is a rope fabricated from a durable material such as nylon. Further, in the preferred embodiment, the engagement means 144 includes grooves defined by the bow pulley 98 and stern pulley 106 about the outer diameter and configured to closely receive the cord 132. Thus, the cord 132 works in conjunction with the tensioning means 138 to remain tightly held in place about the bow and stern pulleys 98, 106 such that as the cord 132 is pulled in a selected direction, at least the stern pulley 106 is rotated and the loop is likewise rotated in the same direction.

It will be seen that the propulsion means cord 132 may be fabricated from a linked chain (not shown). In this embodiment, the engagement means 144 includes a plurality of gear teeth configured to be received by the openings defined by the chain such that as the chain is rotated, the teeth are engaged and the pulleys 98, 106 are rotated in the same direction.

The propulsion means 16 further includes at least one cord engagement means 144 for engaging and rotating the cord 132 and thereby rotating at least the stern pulley 106. In the preferred embodiment, first and second foot mounts 146, 148 are provided for engaging the feet of the boater, the foot mounts 146, 148 being fixed, as described, to the selected cords such that as the first foot mount 146 is moved in a direction toward the bow 38, the second foot mount 148 is moved in a direction toward the stern 40, and vice versa. Thus, in the preferred embodiment, the boater may move his left foot forward thereby causing the right foot to move rearward and ultimately causing the stern pulley 106 to rotate in the clockwise direction, while if the boater moves his right foot forward, his left foot will be pulled rearward and the stern pulley 106 will be rotated counter-clockwise. In the preferred embodiment, the foot mounts 146, 148 include a plurality of wheels 150 for engaging the top member 46, along Which the foot mounts 146, 148 may be selectively rolled in a direction substantially parallel to the longitudinal axis of the boat 10. In this embodiment, the wheels 150 act to reduce the work required to rotate the cord 132.

The propulsion means 16 further includes a water engagement means 152 for displacing water such that the boat 10 is propelled in a selected direction. The water engagement means 152 acts to force water in a direction substantially one hundred eighty degrees (180°) from the selected direction of travel of the boat 10. In the preferred embodiment, the Water engagement means 152 includes a fin 154 defining first and second ends 156, 158. The first end 156 of the fin 154 is fixed to the shaft 108 which is pivotally connected through the first and second plates 116, 122 and fixed to the stern pulley 106. The fin 154 is positioned between the first and second plates 116, 122 in the preferred embodiment. The fin 154 of this embodiment is fabricated from a flexible, yet durable, material such as rubber. preferably, the dimensions of the fin 154 are such that the fin 154 will flex along the horizontal axis while remaining substantially rigid along any vertical cross section. Thus the second end 158 will remain in the substantially vertical position. Thus, as the stern pulley 106 is rotated in either direction, the fin 154 will likewise be rotated in the same direction.

Figure 2:
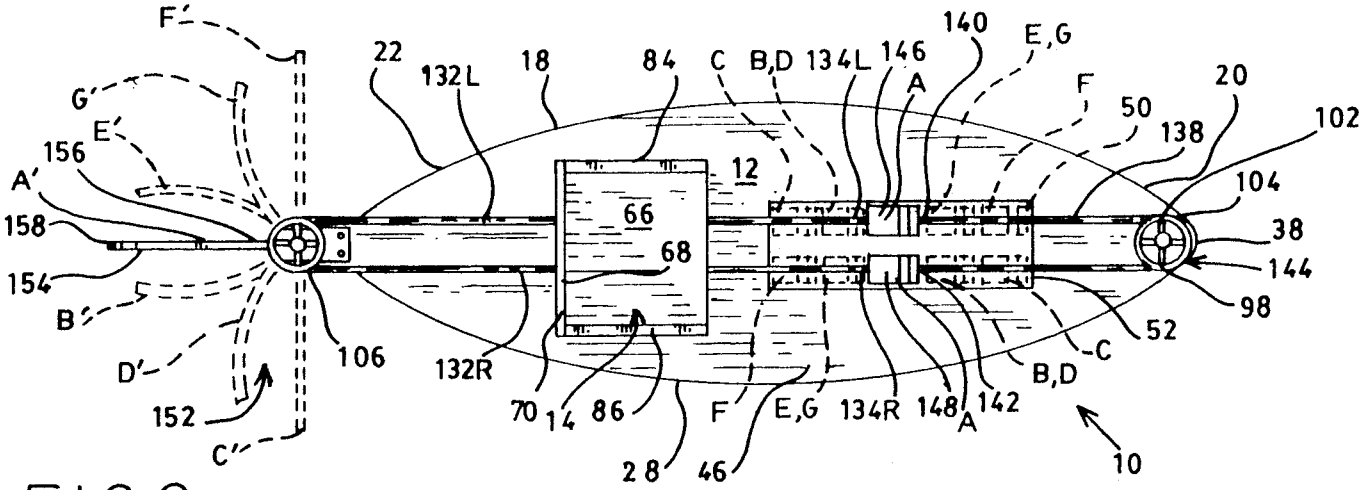
FIG. 2 illustrates a top plan view of the self-propelled boat of FIG. 1.
Figure 3:
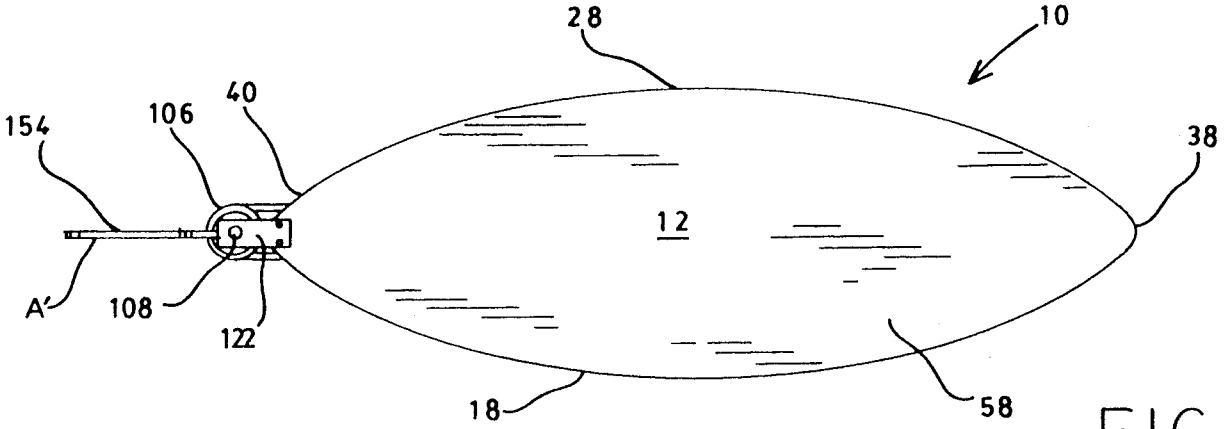
FIG. 3 illustrates a bottom plan view of the self-propelled boat of FIG. 1.

Referring now to FIG. 2, the positioning of the feet of the boater can be seen to effect the orientation of the fin 154. The figure illustrates with solid lines the placement of the foot mounts 146, 148 as indicated by arrow A. The effective orientation of the fin 154 is likewise illustrated with solid lines as indicated by A'. A bottom plan view of this orientation is shown in FIG. 3, wherein also may be seen a bottom plan view of the second plate 122 and the bottom end 112 of the stern pulley shaft 108. Throughout this discussion, and as shown in the figure, the effective position of the fin 154 is designated by the letter assigned to the position of the foot mounts 146, 148 followed by a "'". It can be seen that the flexibility of the fin 154 causes the fin 154 to deform as the stern pulley 106 is being rotated. It will further be seen that positions B and D of the foot mounts 146, 148 coincide, as do positions E and G. However, the shape of the fin 154 is not the same. As the right foot mount 148 is moved toward the bow 38, the stern pulley 106 is rotated counter-clockwise, and likewise, the fin 154 is also rotated. As the fin 154 is so rotated, the second end 158 of the fin 154 will lag behind the first end 156 and thus point toward the left. Conversely, as the fin 154 is turned in the clockwise direction by moving the left foot mount 146 toward the bow 38, the second end 158 Will lag the first end 156 and thus point to the right. Thus it can be seen that the fin 154 deformation will appear substantially mirrored when the foot mounts 146, 148 are being moved in opposing directions. When the foot mounts 146, 148 are no longer displaced by the feet of the boater, the fin second end 158 will point away from the direction of travel due to the water passing on either side. The flex of the fin 154 creates a similar motion as that which propels a fish.

It will be seen that the orientation of the fin 154 substantially controls the direction of travel of the boat 10. If the fin 154 remains in the neutral position, the boat 10 will drift substantially forward. However, when the foot mounts 146, 148 are engaged and moved, the boat 10 will be propelled and turned, depending on the direction of movement of the foot mounts 146, 148. If the right foot mount 148 is pushed forward causing the fin 154 to rotate counter-clockwise, the boat 10 will react by moving forward and turning to the right. When the left foot mount 146 is pushed forward, the fin 154 will turn in the clockwise direction and the boat 10 will be propelled forward while turning to the left. A complete cycle will be defined as starting with the foot mounts 146, 148 in the neutral position A, pushing the foot mounts 146, 148 to position C, then pushing the foot mounts 146, 148 to position F, and finally returning the foot mounts 146, 148 to position A. Thus as the foot mounts 146, 148 are moved a complete cycle, thereby oscillating the fin 154 a complete cycle, the boat 10 is moved forward while being turned to the right and then to the left, thus effectively propelling the boat 10 in a substantially forward course.

In order for the boater to turn the boat 10 in a selected direction, the foot mounts 146, 148 are oscillated between the neutral position A and the position corresponding to the selected direction of turn. For example, if the boater desires to turn to the right, the foot mounts 146, 148 are oscillated between position A and position C. Likewise, if the boater desires to turn to the left, the foot mounts 146, 148 are oscillated between positions A and F.

FIG. 2 further illustrates the top view of a pair of recessed portions 50, 52 of the top member 46. The recessed portions 50, 52 are dimensioned to receive the foot mounts 146, 148 such as to constrain the movement of the foot mounts 146, 148 in a direction substantially parallel with the longitudinal axis of the boat 10. In the preferred embodiment, the recessed portions 50, 52 define substantially smooth top surfaces 54 for the engagement of the foot mount wheels 150 as described above, thus providing a suitable rolling surface. The top surfaces 54 of the recessed portions 50, 52 are elevated a selected height below the top member 46 of the body 12 as shown best in FIG. 5.

Figure 4:
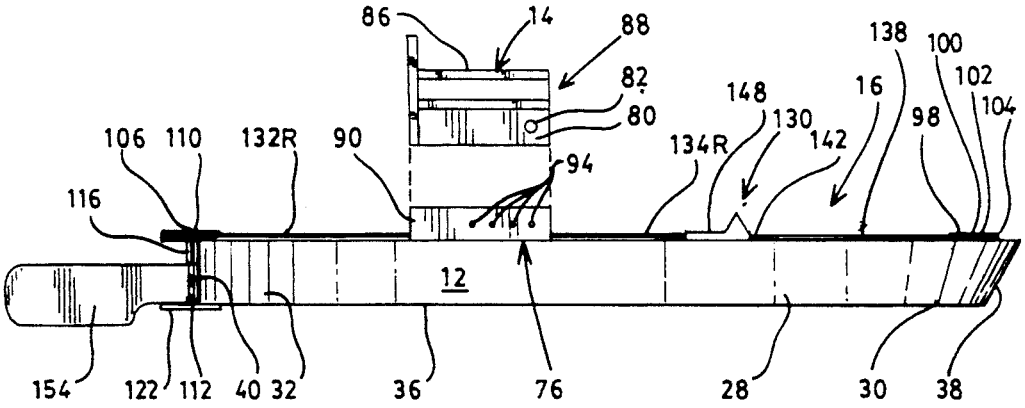
FIG. 4 is an elevation view of the starboard side of the self-propelled boat shown in FIG. 1.

Referring now to FIG. 4, a seat attachment means 76 may be included for attaching the boater support 14 at a selected position along the top member 46 of the body 12. The seat attachment means 76 includes at least one leg member 78 attached to the substantially horizontal planar member 66, the leg member 78 extending downward to engage the top member 46 of the body 12. In the preferred embodiment, first and second leg members 78, 80 are included, the first leg member 78 being attached to the boater support 14 proximate the port side of the boat 10, and the second leg member 80 being attached to the boater support 14 proximate the starboard side of the boat 10. In this embodiment, the respective leg members 78, 80 are positioned between the top member recessed portions 50, 52 and the side walls 18, 28, respectively.

FIG. 4 further illustrates an adjustment means 88 for adapting the boat 10 for use by boaters with longer legs as well as those with shorter legs. The adjustment means 88 further serves to adjust the center of mass of the boater in order to maintain proper balance. In the embodiment including an adjustment means 88, it will be seen that the seat attachment means 76 is attached only to the substantially horizontal planer member 66 or the top member 46 of the body 12, but not both. The seat adjustment means 88 of the preferred embodiment includes at least one positioning bracket 90 attached to the top member 46 of the body 12. The positioning bracket 90 of this embodiment has an elongated configuration and is positioned along the top member 46 such as to be in close proximity to the seat attachment leg members 78, 80. The positioning bracket 90 is attached to the top member 46 of the boat 10 in any conventional method such as with screws or bolts. In the preferred embodiment, first and second brackets 90, 92 are included and attached along the top member 46 such that when the boater support 14 is in place, the first and second brackets 90, 92 are respectively positioned proximate the first and second leg members 78, 80. In the embodiment shown, the brackets 90, 92 are positioned between the leg members 78, 80 and the recessed portions 50, 52, respectively.

A plurality of openings 94 are defined by at least one bracket 90, the openings 94 being spaced apart along the longitudinal axis of the bracket 90. At least one opening 82 is defined by the cooperating leg member 78 such as to selectively cooperate with any of the openings 94 defined by the bracket 90 to receive a locking member 96. The locking member 96 serves to fix the position of the leg member 78 with respect to the bracket 90, thus fixing the position of the boater support 14 with respect to the body 12 of the boat 10. The locking member 96 of the preferred embodiment includes a pin dimensioned to be closely received by the opening 82 defined by the leg member 78 and a selected opening 94 defined by the bracket 90.

FIG. 4 further illustrates the preferred relative positions of the bow and stern pulleys 98, 106 in the horizontal direction. As described above, the bow and stern pulleys 98, 106 are aligned in a horizontal plane for efficient operation of the propulsion means 16. The engagement of the cord 132 is further depicted in a taut engagement with the bow and stern pulleys 98, 106.

Figure 5:
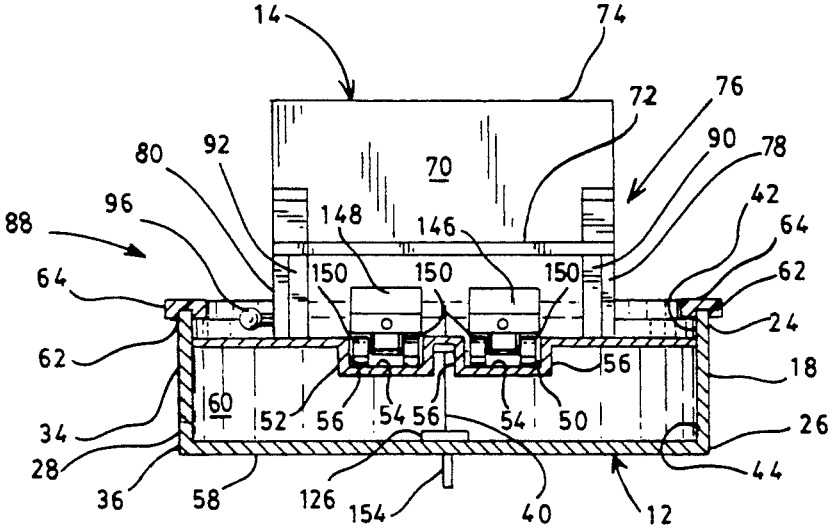
FIG. 5 illustrates an elevation view, in section, of the bow of the self-propelled boat taken along lines 5—5 of FIG. 1.

Referring now to FIG. 5, which is an elevation view on the bow 38, in section, the boater support attachment means 76 is shown as described above. Further, the seat adjustment means pin 96 can be seen in place so as to fix the position of the boater support 14 with respect to the body 12 of the boat 10.

As can be seen, the top member 46 of the body 12 may be elevated a selected distance below the top edges 24, 34 of the side walls 18, 28. A lip 62 is thus defined for retaining selected equipment such as fishing rods (not shown). The lip 62 extends along at least a portion of the top edges 24, 34 of the side walls 18, 28. In the preferred embodiment, the lip 62 circumvents the body 12 of the boat 10. A protective strip 64 may be provided to cover, and thus protect, the lip 62. The protective strip 64 of the preferred embodiment is fabricated from a resilient, pliable material such as rubber molding.

The recessed portions 50, 52 are further illustrated in FIG. 5. In this figure, the top surface 54 and side walls 56 are shown to closely receive the respective foot mounts 146, 148. The side walls 56 can be seen to serve to prevent lateral movement while allowing the foot mounts 146, 148 to move in a direction parallel to the longitudinal axis of the boat 10.

Figure 6:
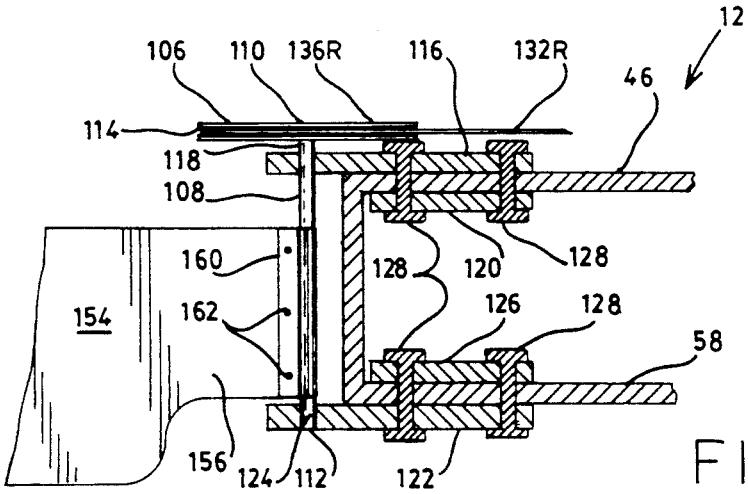
FIG. 6 illustrates a partial starboard elevation view of the present invention showing the fin assembly in connection with the stern of the boat.
Figure 7:
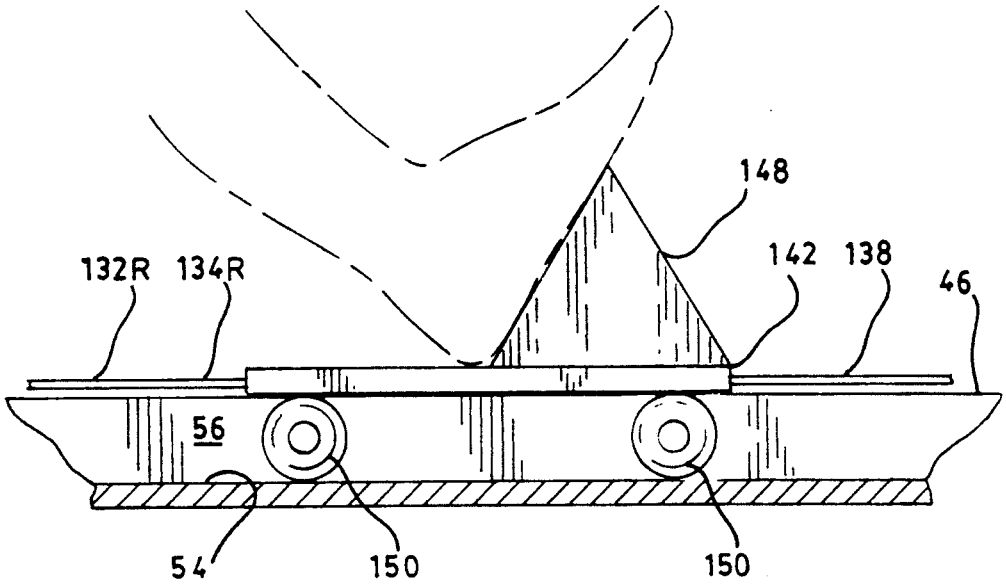
FIG. 7 is a side elevation view of a foot mount being engaged by a boater.

Referring now to FIG. 6, the fin 154 connection is shown proximate the stern 40. The first and second plates 116, 122 are best illustrated in FIG. 6 as oppositely disposed in a vertical direction, the first plate 116 being attached to the top member 46 and the second plate 122 being attached to the bottom member 58. First and second reinforcing plates 120, 126 may be included for relieving stress caused by the respective plates 116, 122 on the top and bottom members 46, 58. The reinforcing plates 120, 126 may be attached in any conventional means such as with bolts or screws. In the embodiment shown, the reinforcing plates 120, 126 are attached using fasteners 128 common with the respective plates.

The stern shaft 108 is shown being closely received by openings 118, 124 defined by the first and second plates 116, 122 such as to be pivotally mounted. The bottom end 112 of the shaft 108 is pivotally attached to the opening 124 defined by the second plate 122 such that the position of the shaft 108 is fixed, by any conventional means, in relation to the first and second plates 116, 122 and movement is restricted to rotation about the longitudinal axis of the shaft 108. The top end 110 of the shaft 108 is fixed to the center of the stern pulley 106, as described above, such that the stern pulley 106 is oriented in a substantially horizontal position a selected distance above the top member 46 of the boat 10.

The first end 156 of the fin 154 is fixed to the shaft 108 by a conventional means. In the illustrated embodiment, a clamp 160 is fixed to the shaft 108 by welding. It will be understood that the clamp 160 may be attached by any other conventional method. The first end 156 of the fin 154 is connected to the clamp 160 with rivets, or any other conventional fasteners 162.

It will be seen from the illustrations taken as a whole that a self-propelled boat 10 is provided for a boater to maneuver himself along the surface of a shallow body of water where the use of a motorized boat or a deep bottom boat is impossible or otherwise impractical. The boat 10, of course, may likewise be used in deeper bodies of water.

A body 12 is provided to carry the boater and serve to provide buoyancy. A seat 14 is provided as a means for allowing the boater to rest on the boat 10. The seat 14 may be moved along the longitudinal axis of the body 12 such that boaters with longer legs may use the boat 10 with the same ease that a boater with shorter legs.

A propulsion means 16 is provided such that the boat 10 may be maneuvered along the surface of the water. The propulsion means 16 includes first and second foot mounts 146, 148 for securing the feet of the boater. The foot mounts 146, 148 are connected to stern pulley engagement cords 132L, 132R and a tensioning cord 138 such as to form a loop. The foot mounts 146, 148 are attached on opposing sides of the loop such that as one is displaced in a first direction, the other is displaced an equal magnitude in the opposite direction. The engagement cords 132L, 132R are releasably connected to the foot mounts 146, 148 such that the respective lengths of the engagement cords 132L, 132R may be adjusted to compensate for longer- or shorter-legged boaters.

The cords 132L, 132R are held in place by two pulleys 98, 106, one pulley 98 being pivotally mounted at the bow 38 and another pulley 106 pivotally mounted at the stern 40. As the boater oscillates the foot mounts 146, 148 forward and then rearward, the cords 132L, 132R serve to simultaneously oscillate the stern pulley 106. The stern pulley 106 then serves to oscillate a shaft 108 connected at one end 110 to the center of the stern pulley 106.

A fin 154 is connected at one end 156 to the stern pulley shaft 108 such that as the shaft 108 is oscillated, the fin 154 is likewise oscillated and the boat 10 is thus propelled in reaction to the movement of the fin 154. The fin 154 is fabricated from a flexible material such as rubber such that as the fin 154 is oscillated in the water, a movement similar to the fin of a fish is accomplished.

From the foregoing description, it will be recognized by those skilled in the art that a self-propelled boat offering advantages over the prior art has been provided. Specifically, the self-propelled boat is designed to propel a boater along the surface of a shallow body of water using power derived through the boater's legs, the boater's feet being supported as the boat is propelled. The self-propelled boat is designed to be propelled in a substantially straight course while also being able to be selectively steered in either direction.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A self-propelled boat for maneuvering about the surface of a body of water, said self-propelled boat being powered by the legs of a boater, said self-propelled boat comprising:

a body means for supporting said boater above said water surface, said body means including at least top and bottom members and starboard and port side walls, said starboard and port side walls defining a stern and a bow;

boater seat means carried by said body means for providing a seat within which said boater may be positioned, said boater seat means being selectively positioned about said body means proximate said top member;

propulsion means for selectively propelling said self-propelled boat, said propulsion means being engaged by feet of said boater such that said self-propelled boat is powered by said boater, and said propulsion means selectively turning said boat so as to propel said boat in a selected direction, said propulsion means including a water displacement means at least partially submerged in said body of water, and an oscillating means for engaging said water displacement means, said water displacement means including at least a fin fabricated from a durable, flexible material, and said oscillating means including at least a stern pulley pivotally attached proximate said stern, a bow pulley pivotally attached proximate said bow, at least one stern pulley engaging cord at least partially entrained about said stern pulley, at least one bow pulley engaging cord at least partially entrained about said bow pulley, and at least first and second foot engaging means, said stern pulley and said bow pulley each pivoting in a substantially horizontal plane, said at least one stern pulley engaging cord and said at least one bow pulley engaging cord being connected in an end-to-end fashion to substantially form a loop, said first and second foot engaging means being oppositely disposed along said loop such that said oscillating means may be actuated for reciprocal travel, said first and second foot engaging means being substantially limited to reciprocating linear travel in a direction substantially parallel to a longitudinal axis of said self-propelled boat defined between said stern and said bow; and tensioning means including at least a portion of said at least one bow pulley engaging cord for biasing said loop in a taut fashion.

2. The self-propelled boat of claim 1 wherein said first foot engaging means is releasably attached to said loop proximate said port side wall and said second foot engaging means is releasably attached to said loop proximate said starboard side wall.

3. The self-propelled boat of claim 1 wherein said oscillating means further includes an attachment means for pivotally attaching said bow pulley to said self-propelled boat, said attachment means including at least a top connector plate, a bottom connector plate, and a shaft member, said top connector plate being fixedly attached to said top member of said body means, said bottom connector plate being fixedly attached to said bottom member of said body means, said top connector plate and said bottom connector plate defining respective first ends extending away from said body means and defining concentric openings centered on said longitudinal axis of said self-propelled boat defined between said stern and said bow, said openings being dimensioned to closely receive said shaft member, said shaft member being fixedly connected to the center of said bow pulley and being positioned in a substantially vertical position.

4. The self-propelled boat of claim 3 wherein said water displacement means is fixed proximate one end to said shaft member such that as said oscillating means is engaged in said reciprocating travel, said water displacement means is oscillated to affect water displacement.

5. The self-propelled boat of claim 1 wherein said portion of said at least one bow pulley engaging cord included in said tensioning means is fabricated from an elastomeric material.

6. A self-propelled boat for maneuvering about the surface of a body of water, said self-propelled boat being powered by the legs of a boater, said self-propelled boat comprising:

a body means for supporting said boater above said water surface, said body means including at least top and bottom members and starboard and port side walls, said starboard and port side walls defining a stern and a bow;

boater seat means carried by said body means for providing a seat within which said boater may be positioned, said boater seat means being selectively positioned about said body means proximate said top member;

propulsion means for selectively propelling said self-propelled boat, said propulsion means being engaged by feet of said boater such that said self-propelled boat is powered by said boater, and said propulsion means selectively turning said boat so as to propel said boat in a selected direction, said propulsion means including a water displacement means at least partially submerged in said body of water, and an oscillating means for engaging said water displacement means, said water displacement means including at least a fin fabricated from a durable, flexible material, and said oscillating means including at least a stern pulley pivotally attached proximate said stern, a bow pulley pivotally attached proximate said bow, at least one stern pulley engaging cord at least partially entrained about said stern pulley, at least one bow pulley engaging cord at least partially entrained about said bow pulley, at least first and second foot engaging means, and an attachment means for pivotally attaching said bow pulley to said self-propelled boat, said stern pulley and said bow pulley each pivoting in a substantially horizontal plane, said at least one stern pulley engaging cord and said at least one bow pulley engaging cord being connected in an end-to-end fashion to substantially form a loop, said first and second foot engaging means being oppositely disposed along said loop such that said oscillating means may be actuated for reciprocal travel, said first foot engaging means being and releasably attached to said loop proximate said port side wall and said second foot engaging means being releasably attached to said loop proximate said starboard side wall, said first and second foot engaging means being substantially limited to reciprocating linear travel in a direction substantially parallel to a longitudinal axis of said self-propelled boat defined between said stern and said bow, said attachment means including at least a top connector plate, a bottom connector plate, and a shaft member, said top connector plate being fixedly attached to said top member of said body means, said bottom connector plate being fixedly attached to said bottom member of said body means, said top connector plate and said bottom connector plate defining respective first ends extending away from said body means and defining concentric openings centered on said longitudinal axis of said self-propelling boat defined between said stern and said bow, said openings being dimensioned to closely receive said shaft member, said shaft member being fixedly connected to the center of said bow pulley and being positioned in a substantially vertical position, said water displacement means being fixed proximate one end to said shaft member such that as said oscillating means is engaged in said reciprocating travel, said water displacement means is oscillated to affect water displacement; and tensioning means including at least a portion of said at least one bow pulley engaging cord for biasing said loop in a taut fashion.

7. The self-propelled boat of claim 6 wherein said body means top and bottom members and starboard and port side walls are sealably attached to define a sealed interior volume for buoyancy.

8. The self-propelled boat of claim 7 wherein said bottom member is a substantially planar member to allow said self-propelled boat to be deployed in shallow water.

9. The self-propelled boat of claim 6 wherein said first and second foot engaging means are provided with rolling means for moving said first and second foot engaging means along said top member.

10. The self-propelled boat of claim 6 wherein said top member further defines recessed portions dimensioned to closely receive said foot engaging means to restrict movement of said first and second foot engaging means in a direction substantially parallel to said longitudinal axis of said self-propelled boat defined between said stern and said bow.

11. The self-propelled boat of claim 6 wherein said top member is sealably and fixedly attached to said starboard and port side walls a selected distance below a top edge defined by said starboard side wall and a top edge defined by said port side wall thus defining a retaining portion for retaining selected equipment.

12. The self-propelled boat of claim 11 further comprising a retaining portion covering means for protecting at least a portion of said retaining portion, said retaining portion covering means being fabricated from a durable material.

13. The self-propelled boat of claim 6 wherein said portion of said at least one bow pulley engaging cord included in said tensioning means is fabricated from an elastomeric material.

* * * * *